United States Patent [19]

Slater et al.

[11] 4,174,752

[45] Nov. 20, 1979

[54] SECONDARY RECOVERY METHOD AND SYSTEM FOR OIL WELLS USING SOLAR ENERGY

[76] Inventors: Frank W. Slater, P.O. Box 186; Dale Fuqua, P.O. Box 247, Star Route, both of Durant, Okla. 74701

[21] Appl. No.: 871,966

[22] Filed: Jan. 24, 1978

[51] Int. Cl.[2] ..... E21B 43/24; F24J 3/02

[52] U.S. Cl. ..... 166/303; 166/57; 166/272; 126/435; 126/900

[58] Field of Search ..... 166/266, 267, 272, 302, 166/303, 274, 57; 126/270, 271

[56] References Cited

U.S. PATENT DOCUMENTS

| | | | |
|---|---|---|---|
| 1,433,956 | 10/1922 | Knox | 166/267 |
| 2,467,885 | 4/1949 | Freund | 126/271 |
| 2,862,558 | 12/1958 | Dixon | 166/272 |
| 3,103,972 | 9/1963 | Parker | 166/266 |
| 3,152,442 | 10/1964 | Rowekamp | 126/271 X |
| 3,294,167 | 12/1966 | Vogel | 166/272 |
| 3,349,850 | 10/1967 | Schlicht et al. | 166/303 |
| 3,648,771 | 3/1972 | Kelly et al. | 166/272 |
| 3,695,354 | 10/1972 | Dilgren et al. | 166/303 X |
| 3,768,559 | 10/1973 | Allen et al. | 166/272 |

*Primary Examiner*—Stephen J. Novosad
*Attorney, Agent, or Firm*—Clarence A. O'Brien; Harvey B. Jacobson

[57] ABSTRACT

A method for heating recovered crude oil at the site of recovery thereof and injecting at least a portion of such heated crude oil back into the oil formation in order to reduce the viscosity of oil remaining in the oil formation, the invention facilitates recovery of the remaining oil and renders the oil more easily handled through pumping operations. Apparatus according to the invention particularly provides for solar heating of a working fluid circulating through a closed heat exchange coil disposed within a crude oil storage tank located in proximity to one or more operating wells and normally used for temporary storage of oil pumped from the wells. Heat energy carried by the working fluid in the closed coil is transferred to the crude oil within the storage tank, the heated crude oil being then pumped back into the oil formation to heat the remaining oil in the formation, the viscosity of the remaining oil being reduced to allow a greater total recovery of the oil in the formation.

8 Claims, 5 Drawing Figures

28
26
18
35
40
44
45
30
34
36
37
31
32
24
38
13
42
33
44
32
34
38
33

SECONDARY RECOVERY METHOD AND SYSTEM FOR OIL WELLS USING SOLAR ENERGY

BACKGROUND OF THE INVENTION

1. Field of the Invention

The invention relates generally to methods for secondary recovery of crude oil from oil strata formations, the invention particularly relating to a method and apparatus for indirectly heating recovered crude oil by means of solar energy and injecting the heated crude oil back into the oil formation in order to reduce the viscosity of oil remaining in the formation, thereby to facilitate recovery of the remaining oil.

2. Description of the Prior Art

Since primary oil recovery methods known in the art only recover a minor percentage of the crude oil existing in an oil formation, extensive attention has been given especially in the recent past to so-called secondary recovery methods intended to increase the percentage of crude oil recovered from an oil formation. Such secondary recovery methods have included the use of heating devices insertable into an oil well for heating oil in the oil-bearing strata into which the well has been drilled. Such heating devices typically comprise electrical resistance heaters which, due to the high cost of the energy required to operate said heaters, have proven to be of limited utility. Heated fluids have further been injected into an oil formation or circulated within an oil well. For example, Gilchrist, et al., in U.S. Pat. No. 3,357,487, discloses the injection of a hot aqueous driving fluid into an oil well, the heated fluid being primarily intended to increase pressure within the well rather than heat significant portions of the crude oil disposed in the oil formation. Due to the massive amounts of expensive energy required to heat any significant portion of the crude oil in an oil formation, prior attempts to recover oil by such methods have proven impractical. According to the present invention, an economically sound method for secondary recovery of crude oil from an oil formation is provided, the method including heating of the crude oil in an oil formation by pumping of a heated portion of the crude oil recovered from the formation back into the formation to reduce the viscosity of the oil remaining therein. The present method exhibits particular economical feasibility due to the effective conversion of a crude oil storage tank into a solar collector and heat exchange apparatus, which storage tank is typically located in proximity to one or more operating wells and used for temporary storage of oil pumped from the wells.

SUMMARY OF THE INVENTION

In a producing oil field having one or more recovery wells, a crude oil storage tank of large capacity is typically employed to receive the crude oil pumped from the wells. The storage tank is used to temporarily hold the crude oil prior to transport of the oil from the oil field. According to a particular feature of the present invention, a crude oil storage tank is effectively converted into a solar energy collector and/or heat exchange system, solar energy incident upon collector portions of the storage tank heating a working fluid which is circulated within a closed loop circulatory system disposed within the storage tank. Those portions of the closed loop circulatory system contacting the crude oil stored within the storage tank transfer heat from the relatively hot working fluid to the relatively colder crude oil, thereby warming the oil preferably within a temperature range of 90 degrees F. to 180 degrees F. At least a portion of the warmed oil is injected back into the oil-bearing strata of the oil formation to impart heat to the unrecovered oil and to form a less viscous body of crude oil at least near the intake of the oil well. An increased percentage of the crude oil in the oil formation is thereby ultimately recovered. Major portions of the crude oil recovered according to the invention are taken from the storage tank by known means and processed in a known manner. The lower viscosity of the crude oil recovered according to the invention allows more ready handling thereof such as by pumping operations.

While the invention particularly contemplates the use of the storage tank itself as a solar collector, the invention can be otherwise practiced, such as by disposing separate solar collection apparatus externally of the storage tank, the heated working fluid being circulated within the storage tank through a closed loop circulatory system, only portions of the closed loop circulatory system edtending into the interior of the storage tank. The invention further contemplates the use of the storage tank, or at least portions thereof, as a solar collector with supplemental heat energy being provided by auxiliary solar collection apparatus disposed within the closed loop circulatory system but externally of the storage tank.

While the invention is described herein as particularly utilizing solar energy, it is to be understood that the invention can be practiced by the addition of heat energy into the present system from any available source, particularly geothermal and similar sources. Further, direct heating of the crude oil removed from the oil formation is also contemplated according to a basic practice of the invention, the relatively warmer crude oil recovered from the oil formation and heated on recovery thereof being returned according to the invention to the formation for reducing the viscosity of at least portions of the total body of crude oil in the formation.

Accordingly, it is an object of the present invention to provide a method and apparatus for heating recovered crude oil at the site of recovery thereof and injecting at least a portion of such heated crude oil back into the oil formation, thereby to reduce the viscosity of oil remaining in the oil formation and to thus increase the percentage of crude oil recoverable from the formation.

It is another object of the invention to provide a method and apparatus for utilizing solar energy for heating recovered crude oil, at least portions of the heated crude oil being injected back into the oil formation to facilitate recovery of and increase the percentage of recovered oil from the formation.

It is a further object of the invention to provide a crude oil storage tank used to temporarily hold crude oil prior to transport of the oil from an oil field, the storage tank acting as a solar energy collector and/or heat exchange system, a working fluid circulating within a closed loop circulatory system being heated and transferring heat to the crude oil in order to warm the oil.

These together with other objects and advantages which will become subsequently apparent reside in the details of construction and operation are more fully hereinafter described and claimed, reference being had to the accompanying drawings forming a part hereof, wherein like numerals refer to like parts throughout.

DESCRIPTION OF THE PREFERRED EMBODIMENTS

Figure 1:
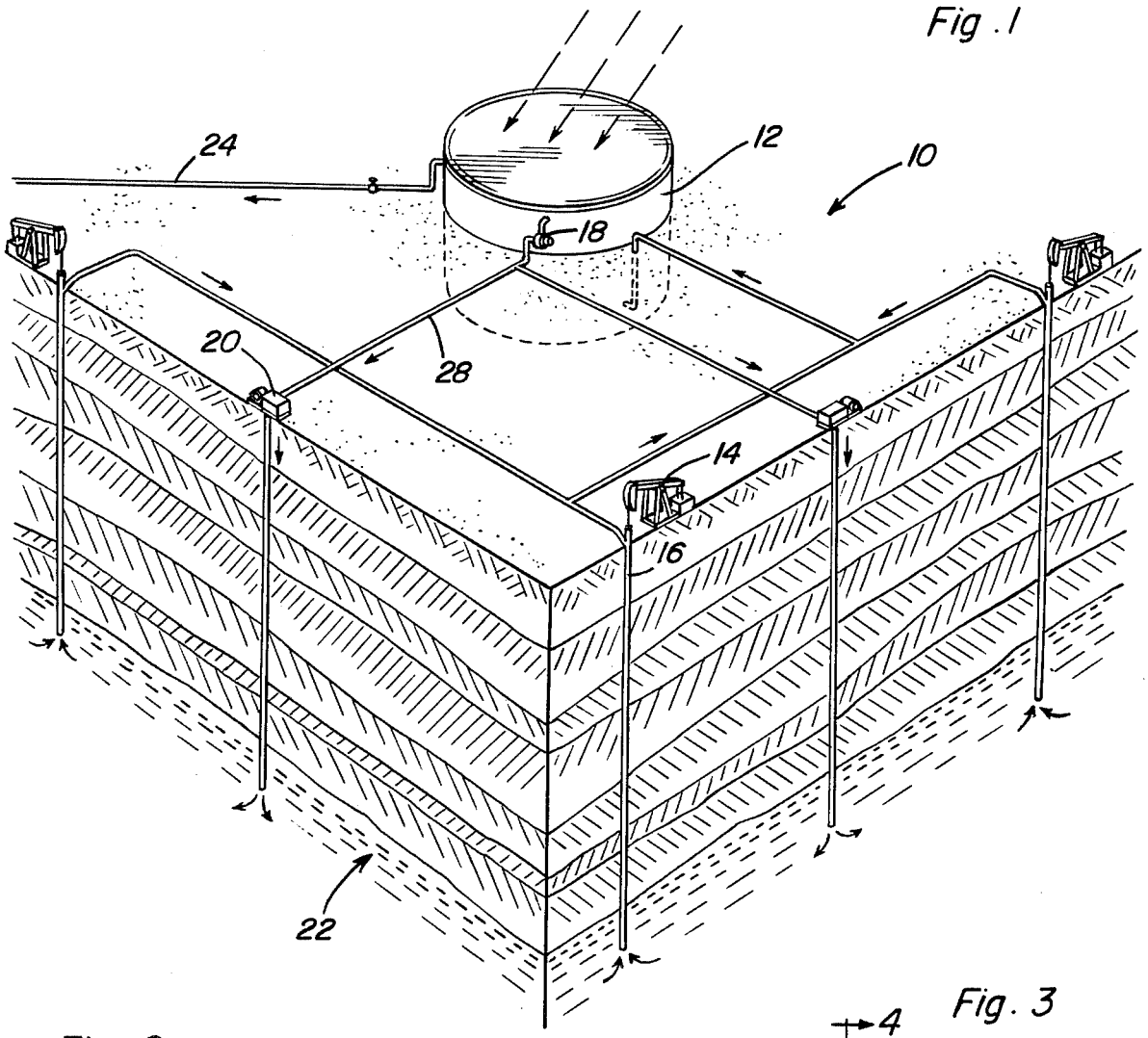
FIG. 1 is an idealized perspective view illustrating the basic method and apparatus of the invention.
Figure 2:
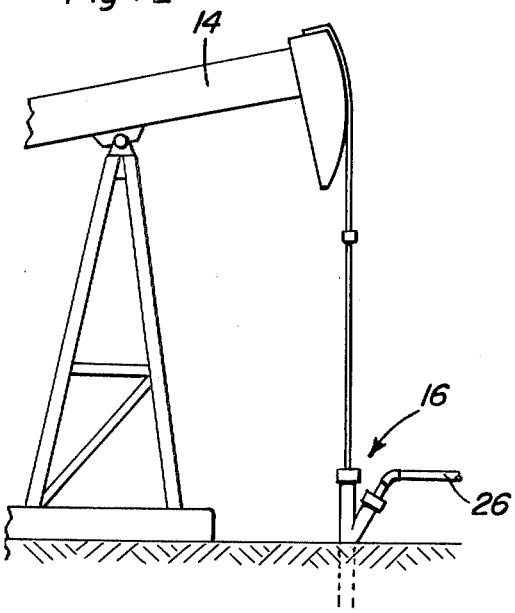
FIG. 2 is an elevational view of an oil recovery pump used in the practice of the invention.

Referring now to the drawings and particularly to FIG. 1, the secondary oil recovery system of the invention is seen at 10 to comprise a storage tank 12 which receives and temporarily holds crude oil 13 pumped into the storage tank 12 by recovery pumps 14. The recovery pumps 14 are of conventional configuration and are disposed on the surface of the earth above individual oil wells 16, the recovery pumps 14 pumping the crude oil 13 through inlet lines 26 into the storage tank 12 from oil-bearing strata 22 into which the intake portions of the oil wells 16 extend. While the storage tank 12 is conventionally used for temporary holding of recovered crude oil prior to transport of the crude oil to a point of use, transfer, or other storage, such as by means of the pipe line 24, the present invention particularly contemplates heating of the crude oil 13 within the storage tank 12 and injection of at least portions of the heated crude oil back into the oil formation as represented by the strata 22. Crude oil heated within the storage tank 12 can be circulated through return line 28 to injection pumps 20 by means of a pump 18 disposed in the return line 28 in proximity to the tank 12. The heated crude oil is thus returned to the oil formation to mix with the relatively viscous crude oil remaining therewithin, the viscosity of the total body of oil in the oil-bearing strata 22 being thereby reduced at least in localized regions of the oil formation.

Figure 3:
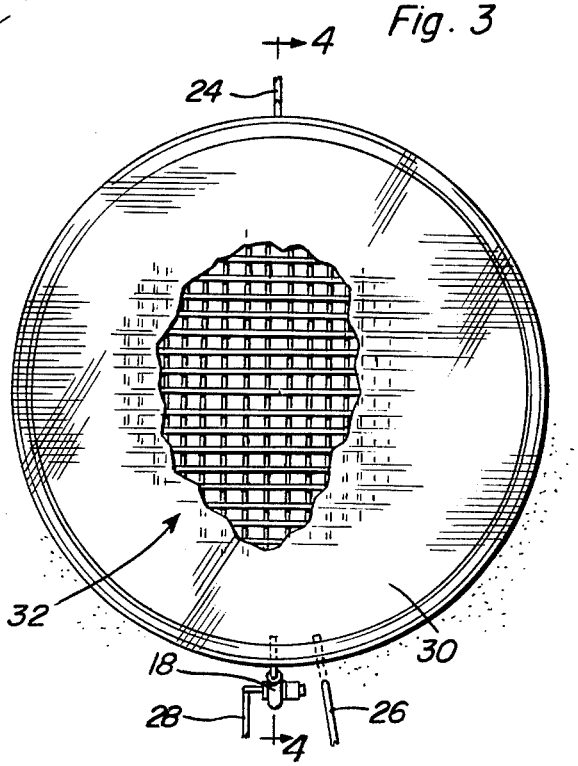
FIG. 3 is a plan view partially cut away of a storage tank configured according to one embodiment of the invention.
Figures 4, 5:
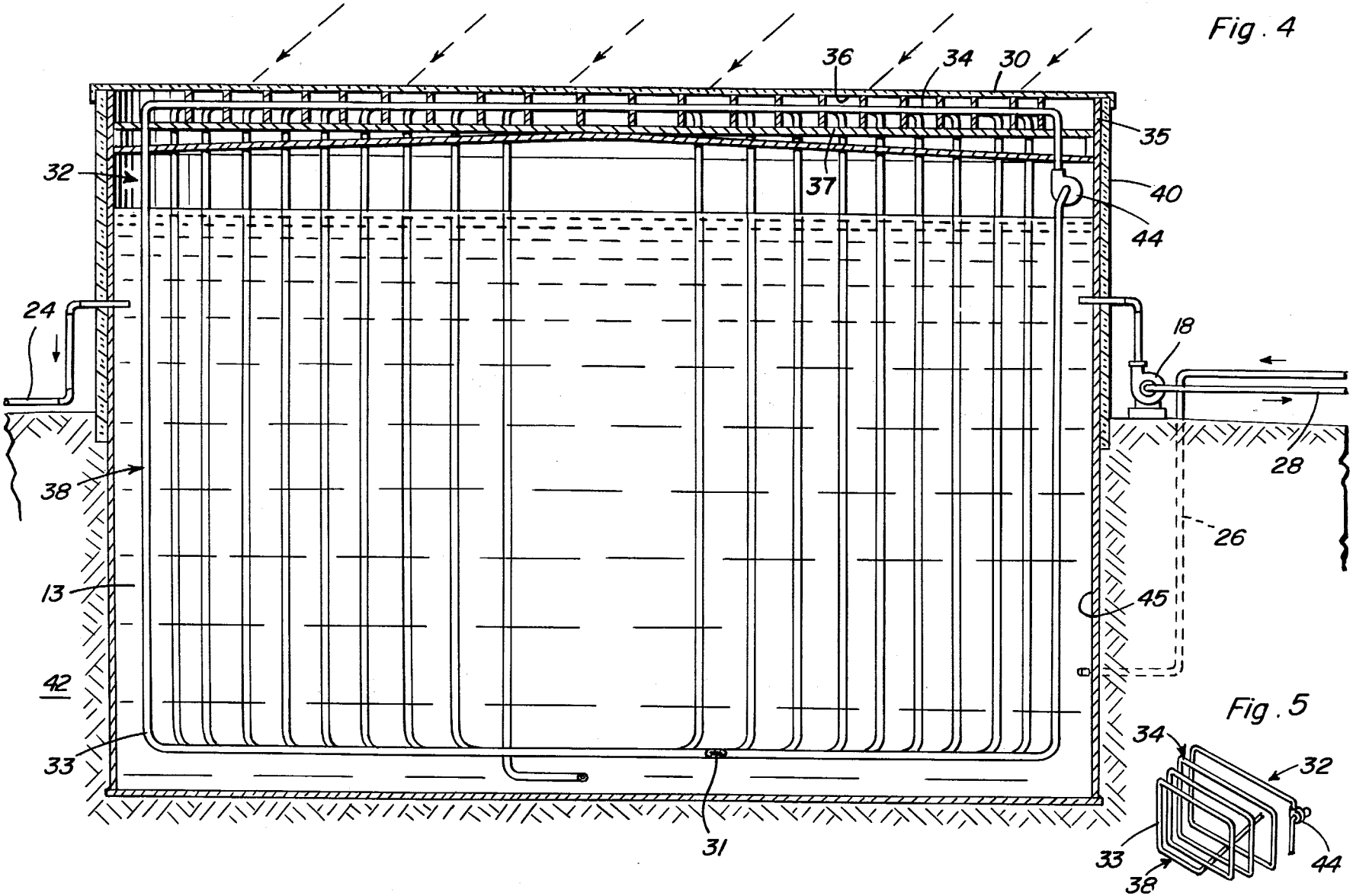
FIG. 4 is a sectional view taken along line 4—4 of FIG. 3.
FIG. 5 is a perspective view of a portion of the closed loop circulatory system of the invention.

Referring now particularly to FIGS. 3 through 5, the storage tank 12 according to a preferred embodiment of the invention is seen to have the top portion thereof take the form of a roof collector plate 30 which is transparent to solar radiation. The roof collector plate 30 defines in cooperation with opaque annular side wall 35 and upper interior wall 37 a heat collector chamber 36. Heat absorbing portions 34 of a closed loop circutory system 32 are disposed within the heat collector chamber 36, a working fluid 31, which can be a liquid or gas, such as a halogenated hydrocarbon, circulates through the closed loop circulatory system 32 due to the action of pump 44. The heat absorbing portions 34 of the system 32 essentially comprise the upper portions of a sinuous continuous pipe 33, the lower portions of which pipe 33 are disposed within oil-containing chamber 45 of the storage tank 12 and constitute heat exchange portions 38 of said system 32. The heat collector chamber 36 defined by the roof collector plate 30 and the walls 35 and 37 acts as a solar collector and can be configured according to the variety of such structures available in the art without departing from the scope of the invention. Within the chamber 36, solar energy incident on and passing through the roof collector plate 30 produces elevated temperature conditions, heat being absorbed through the heat absorbing portions 34 of the closed loop circulatory system 32 by the working fluid 31. The working fluid 31 circulates through the closed loop circulatory system 32 and into the heat exchange portions 38, heat being exchanged through said portions 38 from the working fluid 31 to the relatively colder crude oil 13 within the chamber 45.

Warmer and less viscous crude oil 13 is drawn from the warmer upper layers of the body of crude oil within the storage tank 12 through the return line 28 and injected into the oil-bearing strata 22 of the oil formation by the injection pumps 20. Portions of the warmed crude oil 13 can be removed through the pipe line 24 to additional storage facilities or to transport apparatus (not shown) of known description. The warmed crude oil can be more readily pumped through the pipe line 24, thereby providing an advantage incidental to the primary purpose of the invention. The relatively warm portion of the crude oil injected into the oil formation typically has a preferred temperature of between 90 degrees F. and 180 degrees F., the warmed crude oil radiating and diffusing into the strata 22 to heat the relatively viscous and relatively colder crude oil in the formation. The viscosity of the remaining crude oil in the strata 22 is thus reduced, thereby allowing more ready removal of greater portions thereof through the recovery pump 14.

The storage tank 12 is seen in FIGS. 1 and 4 to have at least lower portions thereof embedded in the earth 42, exposed side wall portions being provided with insulation 40. It should be understood that the tank 12 could be disposed completely beneath ground level except for the roof collector plate 30 for insulative purposes. It should also be understood that the heat absorbing portions 34 of the closed loop circulatory system 32 could be disposed externally of the storage tank 12, the solar collecting portion of the system 10 being located either wholly or partly externally of the tank 12. In such a situation, the continuous pipe 33 would enter the oil-containing chamber 45 through a wall thereof to bring the heating working fluid 31 into heat exchanging relation to the crude oil 13 within the chamber 45. It should also be understood that heat energy from sources other than solar energy sources could be used to warm the crude oil 13 within the chamber 45, heat energy from geothermal or other "low grade" energy sources being particularly useful.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method for secondary recovery of crude oil from an oil formation, comprising the steps of:

disposing a halogenated hydrocarbon working fluid into heat absorbing relation to a source of heat energy to heat the working fluid;

circulating the heated working fluid into heat exchanging relation with the quantity of crude oil to heat the crude oil; and injecting at least portions of the heated crude oil into the oil formation to reduce the viscosity of the crude oil in the oil formation in at least localized portions thereof, thereby to allow a greater recovery of crude oil from the formation.

2. A method for secondary recovery of crude oil from an oil formation, comprising the steps of:

disposing a working fluid into heat absorbing relation to a source of heat energy to heat the working fluid, wherein the source of energy comprises solar energy, circulating the heated working fluid into heat exchanging relation with the quantity of crude oil to heat the crude oil; and injecting at least portions of the heated crude oil into the oil formation to reduce the viscosity of the crude oil in the oil formation in at least localized portions thereof, thereby to allow a greater recovery of crude oil from the formation.

3. A method for secondary recovery of crude oil from an oil formation, comprising the steps of:

pumping a quantity of crude oil from the oil formation into a storage tank;

disposing a closed loop circulatory system at least partially within the storage tank, the closed loop circulatory system having a working fluid circulating therein;

subjecting portions of the closed loop circulatory system to a source of heat energy to cause portions of the working fluid to absorb heat;

disposing portions of the closed loop circulatory system in heat exchanging relation to the crude oil in the storage tank;

circulating the heated working fluid within the portions of the closed loop circulatory system disposed in heat exchanging relation to the crude oil to heat the crude oil; and injecting at least portions of the heated crude oil into the oil formation to reduce the viscosity of the crude oil in the oil formation in at least localized portions thereof, thereby to allow a greater recovery of crude oil from the formation.

4. Apparatus for the secondary recovery of crude oil from an oil formation, comprising:

a storage tank for temporarily holding crude oil, the storage tank acting as heat exchange system having a working fluid circulating within a closed loop circulatory system for transferring heat to the crude oil from the working fluid;

means for heating the working fluid in the storage tank; and pump means for injecting at least portions of the heated crude oil into the oil formation to reduce the viscosity of the crude oil in the oil formation in at least localized portions thereof, thereby to allow greater recovery of crude oil from the formation.

5. The apparatus of claim 4 and further comprising recovery means for pumping crude oil from the oil formation into the storage tank for heating therein.

6. Apparatus for the secondary recovery of crude oil from an oil formation, comprising:

a storage tank for holding crude oil;

means for holding the crude oil in the storage tank;

pump means for injecting at least portions of the heated crude oil into the oil formation to reduce the viscosity of the crude oil in the oil formation in at least localized portions thereof, thereby to allow the greater recovery of crude oil from the formation;

recovery means for pumping crude oil from the oil formation into the storage tank for heating therein;

closed loop circulatory means at least partially disposed within the storge tank for circulating a working fluid in heat exchange relation with the crude oil in the storage tank;

means for heating the working fluid in at least a portion of the closed loop circulatory means; and means for circulating the heated working fluid within the closed loop circulatory means into heat exchange relation with the crude oil, thereby to heat the crude oil by exchange of heat from the working fluid to the crude oil.

7. The apparatus of claim 6 wherein the means for heating the working fluid comprise:

means in the storage tank for defining a chamber and including a wall portion transparent to solar radiation incident thereon, the chamber having at least the said portion of the closed loop circulatory means disposed therein for heating of said working fluid within the chamber due to solar energy concentrated within said chamber.

8. The apparatus of claim 7 wherein the wall portion transparent to solar radiation comprises the roof portion of the storage tank.

* * * * *